US009926174B1

(12) United States Patent
Imerman

(10) Patent No.: US 9,926,174 B1
(45) Date of Patent: Mar. 27, 2018

(54) HOIST ROPE INSTALLATION DEVICE FOR CRANE BOOM

(71) Applicant: LINK-BELT CONSTRUCTION EQUIPMENT CO., L.P., LLLP, Lexington, KY (US)

(72) Inventor: Curtis Imerman, Lexington, KY (US)

(73) Assignee: Link-Belt Cranes, L.P., LLLP, Lexington, KY (US)

( * ) Notice: Subject to any disclaimer, the term of this patent is extended or adjusted under 35 U.S.C. 154(b) by 0 days.

(21) Appl. No.: 14/674,866

(22) Filed: Mar. 31, 2015

Related U.S. Application Data

(60) Provisional application No. 61/973,384, filed on Apr. 1, 2014.

(51) Int. Cl.
*B66C 23/70* (2006.01)
*B66C 23/42* (2006.01)

(52) U.S. Cl.
CPC ..... *B66C 23/42* (2013.01); *B66C 23/701* (2013.01)

(58) Field of Classification Search
CPC ..... B66C 23/04; B66C 23/60; B66C 23/62; B66C 23/64; B66C 23/701; B66C 23/703; B66C 23/706; B66C 23/707; B66C 25/00
USPC ..... 254/389, 394–398
See application file for complete search history.

(56) References Cited

U.S. PATENT DOCUMENTS

| | | | | |
|---|---|---|---|---|
| 2,541,893 | A * | 2/1951 | Speer | B63B 27/10 114/375 |
| 3,154,025 | A * | 10/1964 | Worthington | B60P 1/54 104/126 |
| 3,317,058 | A * | 5/1967 | Kummerman | B63B 27/00 212/307 |
| 3,596,772 | A * | 8/1971 | Pingon | B66C 9/06 212/227 |
| 4,274,574 | A | 6/1981 | Bishop | |
| 4,337,601 | A * | 7/1982 | Vaerk | B66C 23/701 212/347 |
| 4,597,347 | A | 7/1986 | Spanopoulos | |
| 5,375,753 | A | 12/1994 | Barthauer et al. | |
| 5,551,545 | A | 9/1996 | Gelfman | |
| 5,765,981 | A * | 6/1998 | Huang | B66C 5/08 212/316 |
| 8,191,680 | B2 | 6/2012 | McLaughlin et al. | |
| 2003/0180132 | A1* | 9/2003 | Morreim | B66C 19/005 414/458 |
| 2007/0095777 | A1* | 5/2007 | Wierzba | B66C 11/04 212/345 |

* cited by examiner

*Primary Examiner* — Michael R Mansen
*Assistant Examiner* — Juan J Campos, Jr.
(74) *Attorney, Agent, or Firm* — King & Schickli, PLLC

(57) ABSTRACT

A mobile crane for intended use in lifting an object using a hoist rope includes a boom having a first end portion and a second end portion. A carrier or conveyor is provided for carrying the hoist rope from adjacent the first end portion of the boom to adjacent the second end portion of the boom. Related methods are disclosed.

18 Claims, 6 Drawing Sheets

HOIST ROPE INSTALLATION DEVICE FOR CRANE BOOM

This application claims the benefit of U.S. Prov. Patent App. Ser. No. 61/973,384, the disclosure of which is incorporated herein by reference.

TECHNICAL FIELD

The present invention relates generally to cranes and, more particularly to a hoist rope installation device for a crane boom.

BACKGROUND OF THE INVENTION

Various types of boom assemblies for use in cranes or other lifting devices are known in the art. Generally, conventional mobile cranes have an extendable boom assembly including base section carrying a plurality of telescoping boom sections. A hoist rope is generally extended from the rear of the boom to sheaves at the boom tip, which rope is then used to lift loads in connection with the operative, extended boom. Installation of the hoist rope generally involves requiring a person to climb atop the boom and walk the rope along the boom, which can be a perilous exercise.

In an effort to overcome this difficulty, a proposal has been made to provide a device for supporting to the person as they walk the rope along the boom. An example may be found in U.S. Pat. No. 8,191,680. However, this arrangement still requires the person to climb atop the boom and don a harness, which is a time consuming exercise. More efficiency and less risk would be realized by providing a device that provides for the installation of the boom hoist rope without requiring a person to climb onto the boom.

SUMMARY

In one aspect, a mobile crane for intended use in lifting an object using a hoist rope. The crane comprises a boom having a first end portion and a second end portion. A carrier is provided for carrying the hoist rope from adjacent the first end portion of the boom to adjacent the second end portion of the boom.

In one embodiment, the carrier comprises an endless rope extending between first and second pulley arrangements carried by the boom. Each pulley arrangement may comprise a pulley mounted for rotation about a vertical axis. A bracket is provided for connecting each pulley arrangement to the boom, which bracket may be L-shaped and attached to the boom. The boom may comprise a base section and a telescoping section, and the carrier may be supported by the base section.

A further aspect of the disclosure pertains to mobile crane for intended use in lifting an object using a hoist rope. In this aspect, a boom having a first end portion and a second end portion is provided. A first pulley arrangement is mounted adjacent the first end portion of the boom. A second pulley arrangement is mounted adjacent the second end portion of the boom. An endless conveyor, such as a rope, may be associated with the first pulley and the second pulley.

A method of installing a hoist rope on a boom is also provided. The method may comprise conveying via a carrier a portion of the hoist rope from a first end portion of the boom to a second end portion of the boom. The method may further comprise conveying via the carrier the hoist rope portion from the second end portion of the boom to the first end portion.

DETAILED DESCRIPTION

Figure 1:
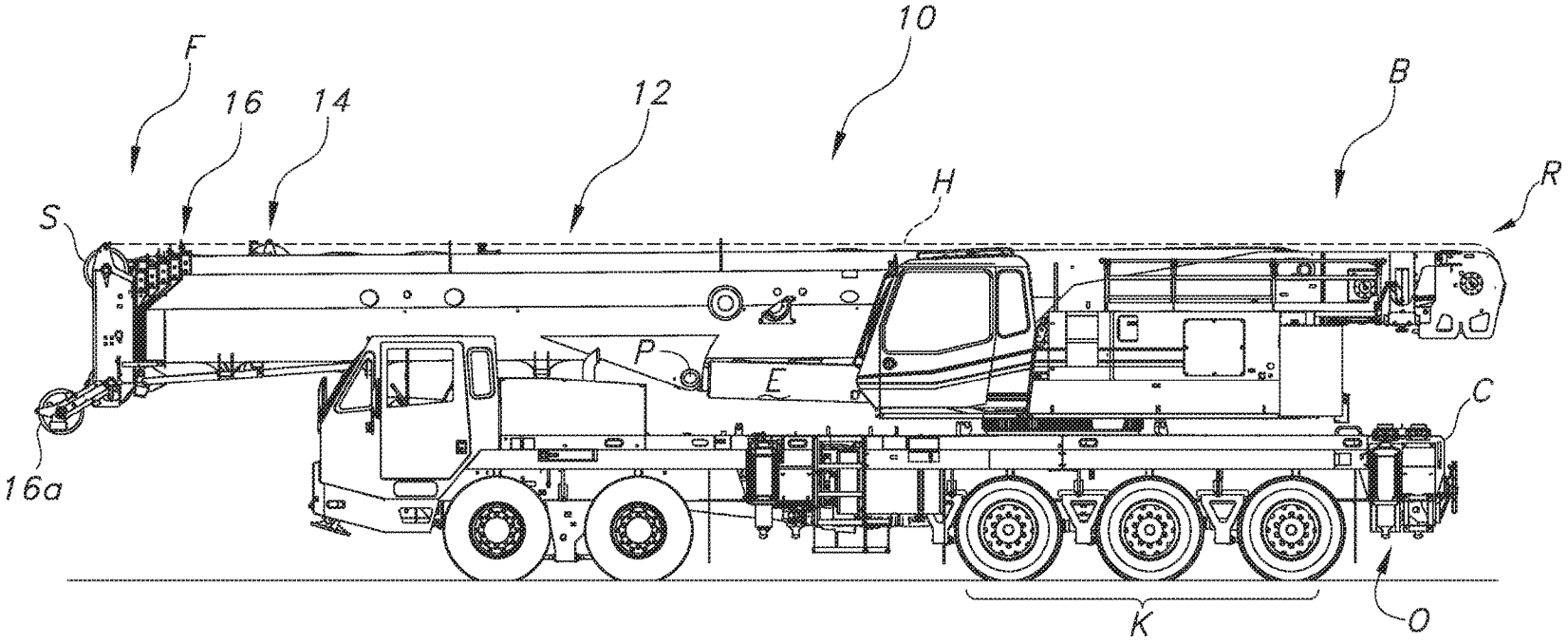
FIG. 1 is a side view of a vehicle to which aspects of this disclosure may be applied.

Reference is now made to FIG. 1, which provides an overall perspective view of a mobile crane 10 for which the inventions described herein may have utility. In the embodiment illustrated in FIG. 1, this crane 10 includes a telescoping boom assembly 12 having at least two generally tubular boom sections, such as a base section 14 and one or more extensible section 16. The first or outer base boom section 14 is pivotally mounted on a bodily rotatable base B supported by a chassis C having ground-engaging structures (e.g., wheels K or crawler tracks and outriggers O), while the second boom section 16 is telescopically received within the first or base boom section 14. It should be appreciated that additional boom sections may be telescopically received within the second boom section 14 and so on. An internal hydraulic cylinder (not shown) is provided to move the telescoping boom sections 14, 16 relative to each other in a manner known in the art, and a lifter E, such as an external cylinder, connects with the boom assembly 12 at a connection point P, and can be used to pivot it in a vertical direction in a selective fashion to lift objects using a hoist rope H (shown in dashed line representation in FIG. 1), which may extend over one or more sheaves S at the boom head end 16*a*.

Figure 2:
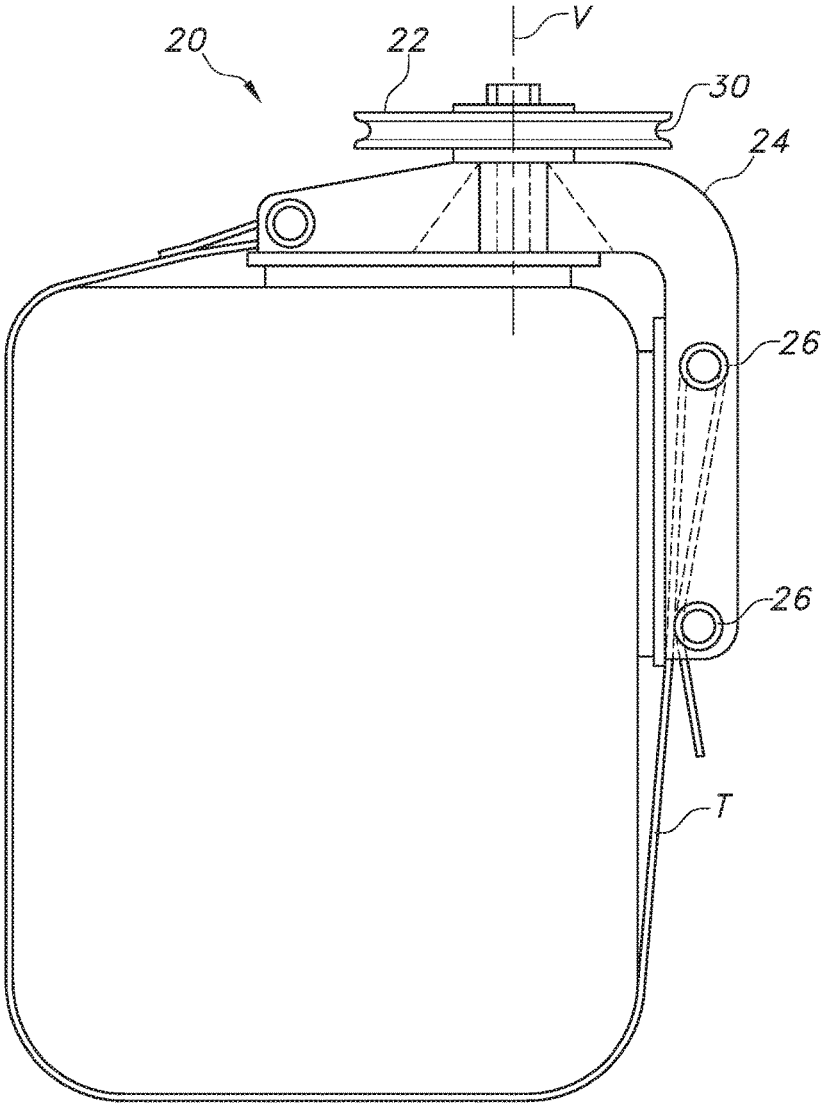
FIGS. 2-5 illustrate various aspects of a first embodiment.

A device is now provided for extending the hoist rope H from a first part of the boom assembly 12, such as the rear end portion R, to a second part of the boom assembly, such as the front end portion F. With reference to FIG. 2, the device includes first and second pulley arrangements for mounting to the boom in a spaced apart relationship. In a particular example, a first pulley arrangement is mounted at the front end portion F of the boom assembly 16, and a second pulley arrangement is mounted to the rear end portion R of the boom assembly 12.

Figure 3:
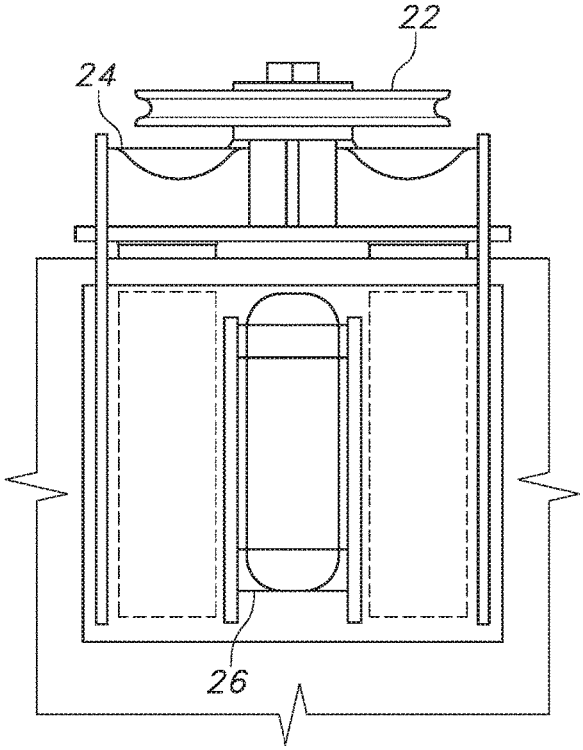

FIG. 2 shows one such pulley arrangement 20 in an elevational view, and FIG. 3 is a side view. Each pulley arrangement 20 includes a pulley 20, which in the illustrated embodiment is mounted for rotation about a vertical axis V generally orthogonal to a direction of elongation of the boom assembly 16 (but other arrangements can be used, as shown below). The pulley arrangements 20 may be identical, and may be connected to the base boom section 14 by a fastener, such as a strap T.

Figure 4:
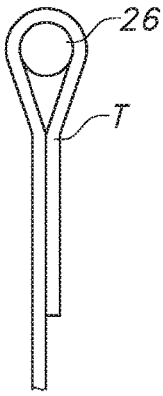
Figure 5:
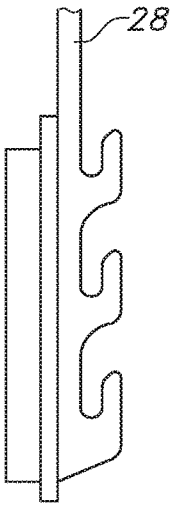
Figure 6:
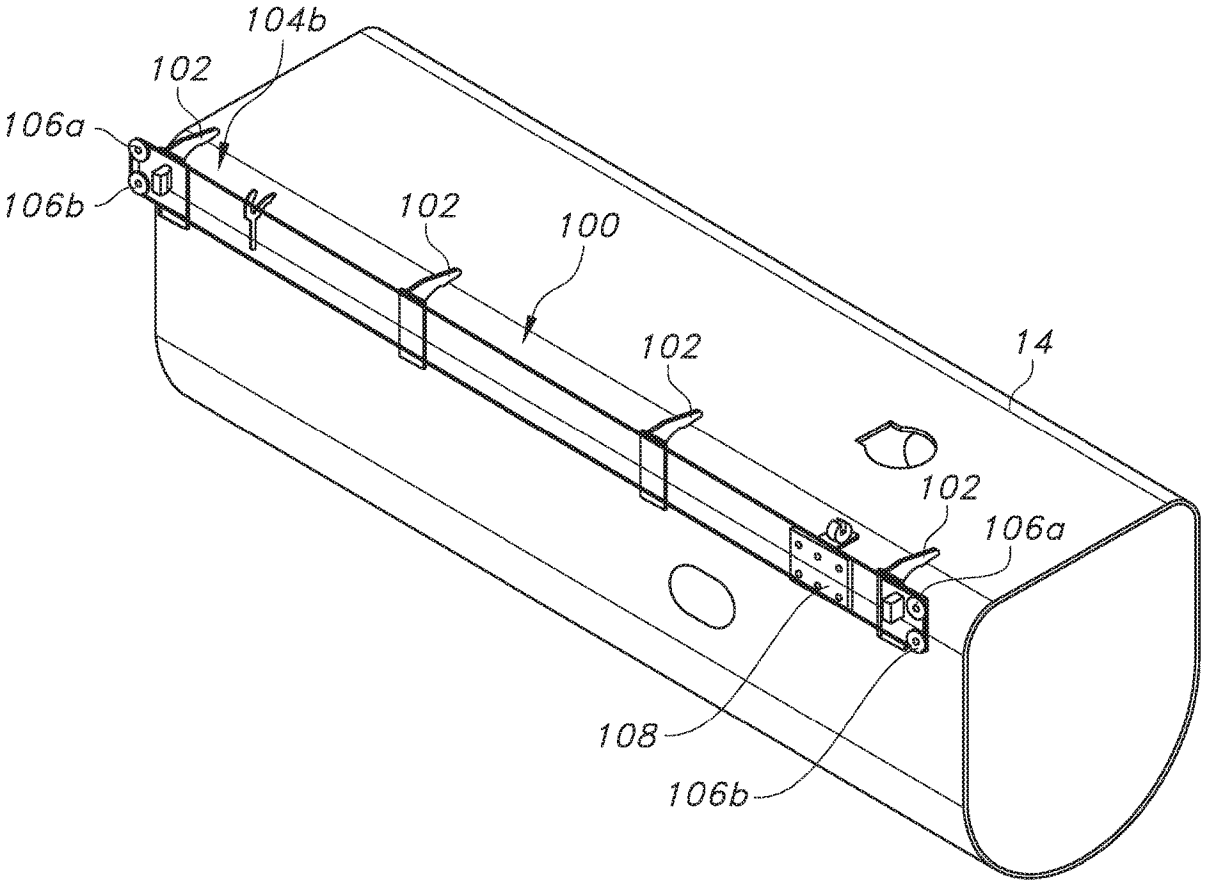
FIGS. 6-10 illustrate various aspects of a second embodiment.
Figure 7:
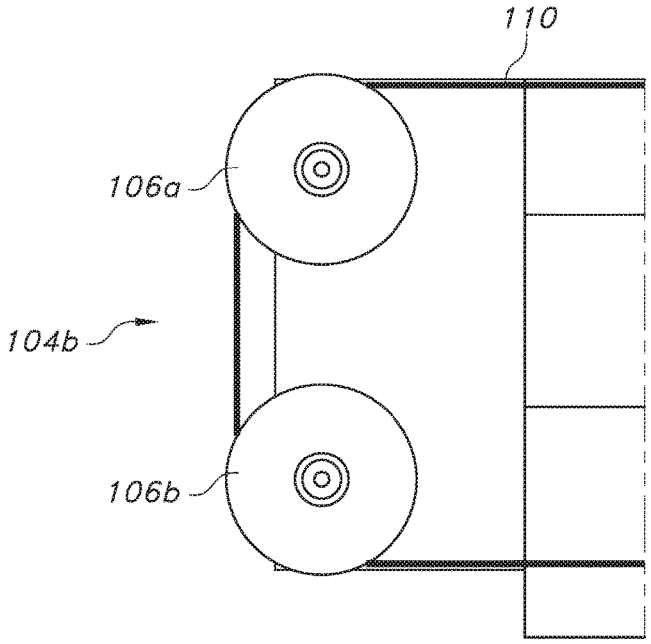

Each pulley arrangement 20 may include a bracket 24 to which the strap T is connected (such as by looping it over a cross bar 26; see FIG. 4). Alternatively, the cross bar 26 (or bars) may in turn lock into a notched support 28 (FIG. 5), which may be connected to the boom base section 14. Still another alternative is to fasten each pulley arrangement 20 to the boom in a more permanent manner, such as by welding.

A carrier in the form of an endless rope 30 is provided for connecting with the pulley 22 of each pulley arrangement 20 of the device. As can be appreciated, by connecting one end of the hoist rope H to the rope 30 at the rear end R of the boom, such as using a fastener, and then causing the rope 30 to advance the point of connection, the hoist rope H is caused to move and carried linearly along the boom assembly 16. Once adjacent the front end F, the hoist rope 30 may be detached and positioned over the sheave S. As should be appreciated, this may be accomplished without requiring the presence of a person on the top of the boom assembly 16.

An alternate, but conceptually similar, embodiment is shown with reference to FIGS. 5-10. In this embodiment, the device 100 comprises brackets 102 that support a pulley arrangement 104*a*, 104*b* at each end portion F, R of the boom base section 14. Each pulley arrangement 104*a*, 104*b* in this embodiment includes a pair of pulleys 106*a*, 106*b*, which are mounted for rotation about an axis transverse to the direction of elongation of the boom base section 14.

A carrier 108 is connected to an endless rope 110 extending over the pulleys 106*a* 106*b* of each pulley arrangement 104*a*, 104*b*. The carrier 108 may be supported by a rail 112 extending in the longitudinal direction, such as along the boom base section 14, and also connected thereto by brackets 102. The carrier 108 may comprise one or more supports 108*a* and wheels 108*b* for being movably retained upon the rail (such as by way of a tongue and groove arrangement).

Figure 8:
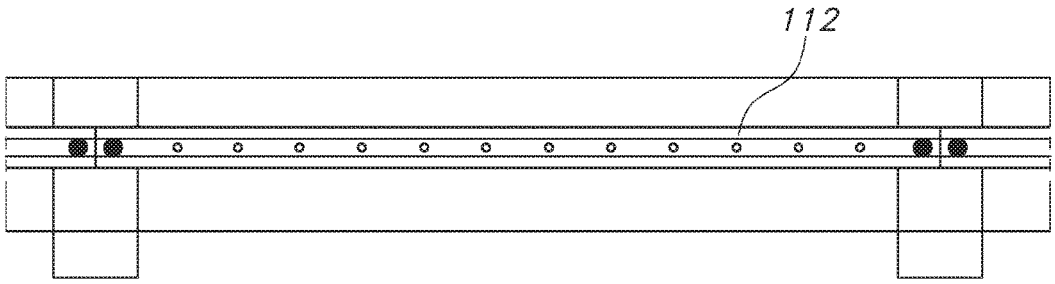
Figure 9:
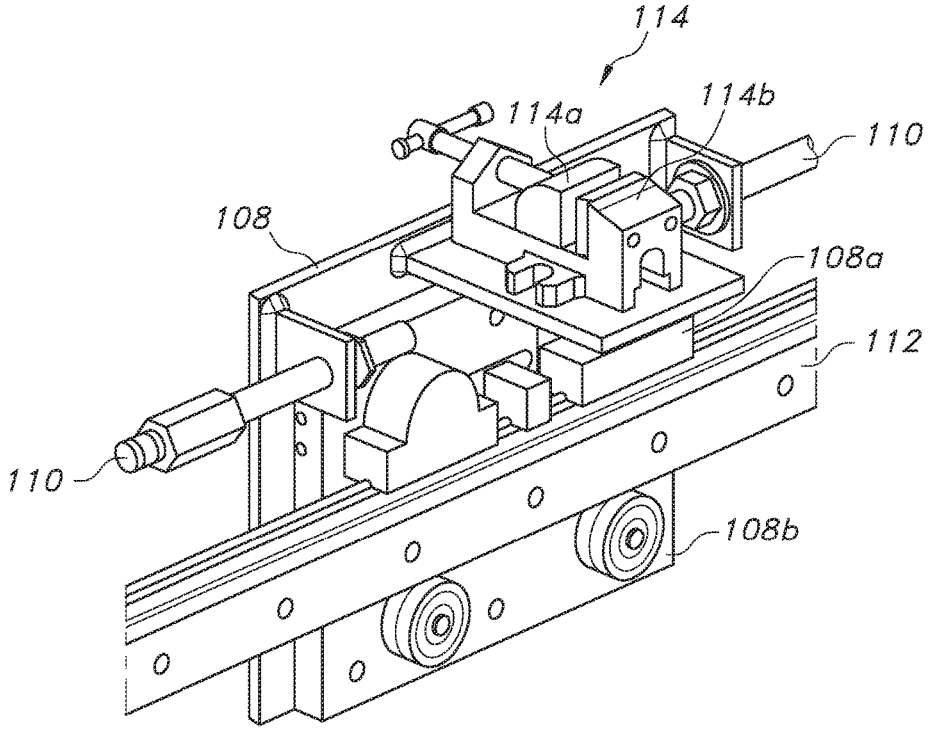
Figure 10:
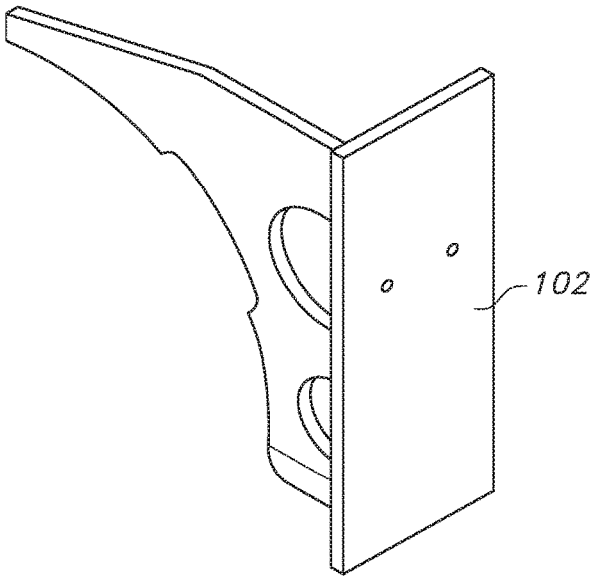

As shown in FIG. 8, the carrier 108 may include a gripper 114 for gripping the hoist rope H. The gripper 112 may comprise a pair of jaws 114*a*, 114*b*, one of which is adjustable toward and away from the other for engaging or disengaging with the hoist rope H. As can be appreciated, this allows for the rope H to be attached and released in an efficient manner.

In use, the operation is the same as in the above embodiment. The rope 110 is caused to rotate about the pulleys 106*a*, 106*b*. This in turn moves the carrier 108 along the boom base section 14 in the longitudinal direction from the rear end R to the front end F when moved in a clockwise direction. At the front end F, the hoist rope may be detached and put into the operative position. The carrier 108 may remain at the front end F, or may be retracted.

In both cases, the movement of the hoist rope H may be automated by providing an actuator for actuating at least one of the pulleys 22, 106*a*, 106*b*. This may be done by a hand crank, motor, or any other mechanism capable of causing at least one of the pulleys to rotate.

The foregoing description of certain embodiments provides the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A mobile crane for intended use in lifting an object using a hoist rope, comprising:

a boom having an outermost exterior surface including a first end portion and a second end portion; and first and second pulleys spaced entirely external to the outermost exterior surface of the boom, the first pulley being positioned at the first end portion of the boom and the second pulley being positioned at the second end portion of the boom, the first and second pulleys supporting an endless rope spaced externally from the outermost exterior surface for carrying the hoist rope along the outermost exterior surface from adjacent the first end portion of the boom to adjacent the second end portion of the boom.

2. The crane of claim 1, wherein each pulley is mounted for rotation about a vertical axis.

3. The crane of claim 1, further including a bracket for connecting each of the first and second pulleys to the boom.

4. The crane of claim 3, wherein the bracket is generally L-shaped.

5. The crane of claim 3, wherein the bracket is attached to the outermost exterior surface of the boom and extends along a top outer face and a side outer face of the boom.

6. The crane of claim 1, wherein the boom comprises a base section and a telescoping section positioned at least partially within the base section, and the first and second pulleys are connected to the outermost exterior surface of the base section.

7. A method of installing a hoist rope on a boom using the crane according to claim 1, comprising:

conveying via the endless rope a portion of the hoist rope from the first end portion of the boom to the second end portion of the boom along the exterior surface of the boom.

8. The method of claim 7, comprising conveying via the carrier the hoist rope portion from the second end portion of the boom to the first end portion.

9. The crane of claim 1, wherein the boom comprises a sheave at the first end portion for use in raising and lowering the hoist rope once installed.

10. The crane of claim 1, wherein the boom comprises a top face and a side face, and the first and second pulleys are mounted for projecting externally from the top face of the boom.

11. A mobile crane, comprising:

a boom having a first end portion and a second end portion;

a first pulley mounted external to and spaced from an outermost exterior surface of the boom;

a second pulley mounted external to and spaced from the outermost exterior surface of the boom; and an endless rope associated with the first pulley and the second pulley and extending along the outermost exterior surface from the first end portion of the boom to the second end portion of the boom.

12. The crane of claim 11, wherein the boom comprises a base section and a telescoping section, and the first and second pulleys are connected to the base section.

13. The crane of claim 11, wherein the boom comprises a sheave at the first end portion for use in raising and lowering the hoist rope once installed.

14. The crane of claim 11, wherein the boom comprises a top face and a side face, and the first and second pulleys are mounted for projecting externally from the top face of the boom.

15. A mobile crane, comprising:

a telescoping boom having an outermost boom section including a first head end portion and a second rear end portion;

a hoist rope for lifting an object in connection with the telescoping boom; and a rope positioned for traversing an endless loop external to the outermost boom section and spaced from an exterior surface of the outermost boom section of the telescoping boom, said endless rope adapted for conveying the hoist rope along an exterior of the telescoping boom from adjacent the first head end portion of the boom to adjacent the second rear end portion of the telescoping boom.

16. The crane of claim 15, wherein the telescoping boom comprises a top face and a side face, and the endless rope is positioned above the top face of the boom.

17. The crane of claim 15, further including a hoist adjacent to the rear end portion of the boom for raising and lowering the hoist rope upon being conveyed to the first end portion of the boom.

18. The crane of claim 15, further including a plurality of pulleys positioned in a spaced relationship relative to the exterior surface of the telescopic boom, at least a first of said pulleys associated with the first head end of the boom and at least a second said pulleys associated with the rear end of the boom, wherein said rope extends along the exterior surface of the boom between the first of said pulleys and the second of said pulleys.

* * * * *